US006973686B2

(12) United States Patent
Kenan

(10) Patent No.: US 6,973,686 B2
(45) Date of Patent: Dec. 13, 2005

(54) CORRUGATED CARDBOARD CRIB

(76) Inventor: Ruth Kenan, 77/13 Golomb St., Herzlia (IL)

( * ) Notice: Subject to any disclaimer, the term of this patent is extended or adjusted under 35 U.S.C. 154(b) by 0 days.

(21) Appl. No.: 10/678,066

(22) Filed: Oct. 6, 2003

(65) Prior Publication Data

US 2005/0071919 A1 Apr. 7, 2005

(51) Int. Cl.[7] ..... A47D 7/00
(52) U.S. Cl. ..... 5/101; 5/102; 5/924
(58) Field of Search ..... 5/101, 102, 105, 5/924, 93.1, 99.1, 951; 446/487, 488, 80, 446/478; 229/108, 116.1, 117.01

(56) References Cited

U.S. PATENT DOCUMENTS

| | | | | | |
|---|---|---|---|---|---|
| 1,676,100 | A | * | 7/1928 | Lund | 446/77 |
| 1,720,016 | A | * | 7/1929 | Tinsley | 446/80 |
| 1,982,780 | A | * | 12/1934 | Behrens | 446/80 |
| 2,196,512 | A | * | 4/1940 | Williams et al. | 446/77 |
| 2,239,365 | A | * | 4/1941 | Loth | 446/80 |
| 2,278,124 | A | * | 3/1942 | Kowinski | 446/73 |
| 2,551,089 | A | * | 5/1951 | Behrens | 446/76 |
| 2,619,768 | A | * | 12/1952 | Tomchin | 446/77 |
| 2,950,484 | A | * | 8/1960 | Jaffe | 4/587 |
| 3,235,890 | A | * | 2/1966 | Zalicovitz | 5/98.1 |
| 3,336,608 | A | * | 8/1967 | Lerner | 5/99.1 |
| 3,487,479 | A | * | 1/1970 | Grooms | 5/93.1 |
| 3,656,256 | A | * | 4/1972 | Maskell et al. | 446/396 |
| 3,844,471 | A | * | 10/1974 | Hind | 229/101 |
| 4,250,580 | A | | 2/1981 | Eichenauer | 5/93.1 |
| 4,804,230 | A | * | 2/1989 | Friedman | 297/440.12 |
| 4,934,004 | A | * | 6/1990 | Friedman | 5/94 |
| 5,038,426 | A | | 8/1991 | Boretski | 5/93.1 |
| 5,115,524 | A | | 5/1992 | Antosko | 5/99.1 |
| 5,867,850 | A | | 2/1999 | Mariol | 5/93.2 |

FOREIGN PATENT DOCUMENTS

| | | | | |
|---|---|---|---|---|
| WO | WO 84/00504 | * | 2/1984 | A63H 33/16 |

OTHER PUBLICATIONS http://www.returdesign.se/english/child/5.jpg.

* cited by examiner

*Primary Examiner*—Robert G. Santos
(74) *Attorney, Agent, or Firm*—Mark M. Friedman

(57) ABSTRACT

Disclosed is a baby crib or cradle constructed from foldable material, preferably corrugated cardboard that forms multiple elements from a single sheet of material, and supports the baby above the ground. In kit form, the crib may be supplied in a partially assembled state to facilitate ease of end user assembly.

24 Claims, 16 Drawing Sheets

CORRUGATED CARDBOARD CRIB

FIELD AND BACKGROUND OF THE INVENTION

The present invention relates to baby cribs and cradles and, in particular, it concerns a folded corrugated cardboard crib that supports the user above the ground.

It is known to use corrugated cardboard and similar foldable materials for the construction of pieces of furniture. An advantage of foldable materials such as corrugated cardboard as a construction material is its ability to be folded. Folding may be used to increase strength. Folding may also be used to form what would normally be two or more elements from a single sheet of material. One well known example of this is a box, which if constructed of wood would require at least six separate pieces to construct, four sides, top and bottom. A cardboard box, however, is constructed from a single piece of material that when cut and folded appropriately may be attached to itself along one edge to form four walls, a top and a bottom.

The use of corrugated cardboard in the construction of devices intended as a sleep space for infants is described in U.S. Pat. No. 4,250,580, to Eichenauer; U.S. Pat. No. 5,115,524 to Antosko; and U.S. Pat. No. 5,038,426 to Boritski. These devices utilize the feature of forming multiple elements, such as side walls and bottom, from a single sheet of material. None of the devices are configured to be supported on legs above the ground. That is, they are little more than variations of a box, such that the ground contact surface of each device is the flat bottom of the box.

The cardboard cradle illustrated at www.returdesign.se/english/child/5.jpg has utilized the lightweight strength of cardboard, supports the bed above the ground and is aesthetically pleasing. Each element, however, is formed from a separate piece of material. That is, the two end pieces, two side walls and the bed bottom are formed from five separated pieces. Therefore the feature of forming multiple elements from a single piece of material has not been utilized. It should be noted that the ground contact surface of the end pieces has a contour which will allow the cradle to rock, however, this contour is not shaped in such a way as to limit the degree of rocking motion, therefore, the cradle may tip over if the degree of rocking is too extreme.

There is therefore a need for a crib constructed from foldable material that forms multiple elements from a single sheet of material, and supports the user above the ground.

SUMMARY OF THE INVENTION

The present invention is a crib constructed from foldable material that forms multiple elements from a single sheet of material, and supports the user above the ground.

According to the teachings of the present invention there is provided, a crib comprising: (a) a base system including two end walls configured from foldable sheet material; and (b) at least one wall assembly configured from foldable sheet material and having at least a first preformed fold line so as to form an integral hinge demarcating at least one side wall and at least a portion of a support element, such that a first fold is formed by folding the wall assembly along the first fold line; wherein each of two opposite ends of the wall assembly interconnects with one of the two end walls such that the two end walls extend below the support element.

According to a further teaching of the present invention, the wall assembly is configured with at least the first and a second preformed fold lines so as to form two integral hinges thereby demarcating a support element flanked by two side walls.

According to a further teaching of the present invention, the wall assembly is further configured with at least a third, fourth and fifth preformed fold lines in the support element such that folding the wall assembly along the third, fourth and fifth preformed fold lines forms a downwardly projecting "V" shaped reinforcement rib in the support element.

According to a further teaching of the present invention, the end wall includes a curved ground contact surface configured so as to allow the crib to rock, the curved ground contact surface having a rock-limiting contour.

According to a further teaching of the present invention, each of the end walls is configured from a separate single sheet of material folded over on itself on an end-wall fold such that an outline of a first segment of the end wall on one side of the end-wall fold is substantially a mirror image of at least a portion of an outline of a second segment of the end wall on another side of the end-wall fold.

According to a further teaching of the present invention, in a folded position, abutting surfaces of the first and the second segments are fixedly attached.

According to a further teaching of the present invention, the at least one wall assembly is implemented as two wall assemblies.

According to a further teaching of the present invention, each the wall assembly is configured from a single sheet such that the side wall of the wall assembly is folded over along a side-wall fold such that an outline of a first section of the side wall on one side of the side-wall fold is substantially a mirror image of at least a portion of an outline of a second section of the side wall on another side of the side-wall fold.

According to a further teaching of the present invention, in a folded position, abutting surfaces of the first and second sections of the side wall are fixedly attached.

According to a further teaching of the present invention, each of the wall assemblies is further configured with a preformed reinforcement rib fold line such that folding the wall assembly along the preformed reinforcement rib fold line forms a reinforcement rib projecting downwardly along an edge of the portion of the support element.

According to a further teaching of the present invention, the base system further includes at least one bridging element attached to each of the end walls such that the two end walls are mechanically linked by the bridging element, and the end walls extend below the bridging element.

According to a further teaching of the present invention, the bridging element is configured with at least one longitudinal slot configured to accept insertion of at least one reinforcement rib.

According to a further teaching of the present invention, the bridging element is configured such that each end is folded so as to form attachment flaps to facilitate attachment to the end walls.

According to a further teaching of the present invention, the end walls rotate about a fold created by forming the attachment flaps so as to be transformable between a compact storage state and an assembly state.

According to a further teaching of the present invention, the longitudinal slot extends into the attachment flaps so as to form stabilizing slots adjacent to surfaces of each of the end wall, the stabilizing slots accepting terminal edges of the reinforcement rib.

According to a further teaching of the present invention, the bridging element is configured with at least one preformed lateral fold line such that folding the bridging element along the preformed lateral fold line brings the end walls into facing abutment such that the base system is variable between a compact storage state and an assembly state.

According to a further teaching of the present invention, each of the end walls further includes at least two horizontally spaced apart downwardly extending engagement slots and the side wall includes at least twvo upwardly extending engagement slots, each of the engagement slots located in a region adjacent to a lateral extremity of the side wall, and each of the upwardly extending engagement slots of the side wall mates with a corresponding the downwardly extending engagement slot in each of the end walls thereby interconnecting the side wall with the two end walls.

According to a further teaching of the present invention, each the end wall is configured from at least two layers of material such that each of the downwardly extending engagement slots is configured from corresponding slot portions formed in each of the layers of the end walls such that each of the downwardly extending engagement slots includes an inwardly projecting ridge.

According to a further teaching of the present invention, each of the upwardly extending engagement slots is configured from at least two layers of material such that corresponding slot portions are formed in each of the layers of the side walls and one of the corresponding slot portions is longer than another of the corresponding slot portions such that each of the upwardly extending engagement slots includes a surface channel for engaging the projecting ridge.

According to a further teaching of the present invention, each of the downwardly extending slots is sloped at an angle within the range of from 10°–45° to the vertical.

There is also provided according to the teachings of the present invention, a crib comprising: (a) a base system including two end walls configured from foldable sheet material, each of the two end walls having at least two horizontally spaced apart downwardly extending engagement slots; (b) at least one side wall configured from foldable sheet material and having at least two upwardly extending engagement slots, each of the upwardly extending engagement slots located in a region adjacent to a lateral extremity of the side wall; and (c) at least one support element interconnected with at least one of the base system and the wall assembly, the support element configured to support a load above a surface upon which the crib stands; wherein each of the upwardly extending engagement slots of the side wall mates with a corresponding the downwardly extending engagement slot in each of the end walls thereby interconnecting the side wall with the two end walls.

According to a further teaching of the present invention, the side wall and at least a portion of the support element are integrally formed thereby forming a wall assembly that includes at least a first preformed fold line so as to form an integral hinge demarcating at least one side wall and at least a portion of a support element, such that a first fold is formed by folding the wall assembly along the first fold line.

According to a further teaching of the present invention, the wall assembly is configured with at least the first and a second preformed fold lines so as to form two integral hinges thereby demarcating a support element flanked by two side walls.

According to a further teaching of the present invention, the wall assembly is further configured with at least a third, fourth and fifth preformed fold lines in the support element such that folding the wall assembly along the third, fourth and fifth preformed fold lines forms a downwardly projecting "V" shaped reinforcement rib in the support element.

According to a further teaching of the present invention, each of the end walls is configured from a separate single sheet of material folded over on itself on an end-wall fold such that an outline of a first segment of the end wall on one side of the end-wall fold is a mirror image of at least a portion of an outline of a second segment of the end wall on another side of the end-wall fold.

According to a further teaching of the present invention, abutting surfaces of the first and the second segments are fixedly attached.

According to a further teaching of the present invention, the at least one wall assembly is implemented as two wall assemblies.

According to a further teaching of the present invention, each the wall assembly is configured from a single sheet such that the side wall of the wall assembly is folded over along a side-wall fold such that an outline of a first section of the side wall on one side of the side-wall fold is a mirror image of at least a portion of an outline of a second section of the side wall on another side of the side-wall fold.

According to a further teaching of the present invention, abutting surfaces of the first and second sections of the side wall are fixedly attached.

According to a further teaching of the present invention, each of the wall assemblies is further configured with a preformed reinforcement rib fold line such that folding the wall assembly along the preformed reinforcement rib fold line forms a reinforcement rib projecting downwardly along an edge of the support element.

According to a further teaching of the present invention, the base system further includes at least one bridging element attached to each of the end walls such that the two end walls are mechanically linked by the bridging element, and the end walls extend below the bridging element.

According to a further teaching of the present invention, the bridging element is configured with at least one longitudinal slot configured to accept insertion of at least one reinforcement rib.

According to a further teaching of the present invention, each the end wall is configured from at least two layers of material such that each of the downwardly extending engagement slots is configured from corresponding slot portions formed in each of the layers of the end walls such that each of the downwardly extending engagement slots includes an inwardly projecting ridge.

According to a further teaching of the present invention, each of the upwardly extending engagement slots is configured from at least two layers of material such that corresponding slot portions formed in each of the layers of the side walls such that each of the upwardly extending engagement slots includes a surface channel for engaging the projecting ridge.

According to a further teaching of the present invention, each of the downwardly extending slots is sloped at an angle ranging from 10°–45° to the vertical.

There is also provided according to the teachings of the present invention, a crib comprising: (a) a base system configured from foldable sheet material, the base system including: (i) two end walls; and (ii) at least one bridging element attached to each of the end walls such that the two end walls are mechanically linked by the bridging element, and the end walls extend above and below the bridging element; (b) at least one side wall configured from foldable sheet material, wherein each of two opposite ends of the side wall interconnects with one of the two end walls such that the two end walls extend below the support element; and (c) at least one support element configured to interconnect with at least one of the base system and the side wall, the support element configured to rest on the bridging element; wherein each of two opposite ends of the wall assembly interconnects with one of the two end walls such that the two end walls extend below the support element.

According to a further teaching of the present invention, the side wall and at least a portion of the support element are integrally formed thereby forming a wall assembly that includes at least a first preformed fold line so as to form an integral hinge demarcating at least one side wall and at least a portion of a support element, such that a first fold is formed by folding the wall assembly along the first fold line.

According to a further teaching of the present invention, each of the end walls further includes at least two horizontally spaced apart downwardly extending engagement slots and the side wall includes at least two upwardly extending engagement slots, each of the engagement slots located in a region adjacent to a lateral extremity of the side wall, and each of the upwardly extending engagement slots of the side wall mates with a corresponding the downwardly extending engagement slot in each of the end walls thereby interconnecting the side wall with the two end walls.

According to a further teaching of the present invention, the at least one wall assembly is implemented as two wall assemblies.

According to a further teaching of the present invention, each of the wall assemblies is further configured with a preformed reinforcement rib fold line such that folding the wall assembly along the preformed reinforcement rib fold line forms a reinforcement rib projecting downwardly along an edge the support element.

According to a further teaching of the present invention, the bridging element is configured with at least one longitudinal slot configured to accept insertion of at least one reinforcement rib.

According to a further teaching of the present invention, the bridging element is configured such that each end is folded so as to form attachment flaps to facilitate attachment to the end walls.

According to a further teaching of the present invention, the longitudinal slot extends into the attachment flaps so as to form stabilizing slots adjacent to surfaces of each of the end wall, the stabilizing slots accepting terminal edges of the reinforcement rib.

According to a further teaching of the present invention, the bridging element is configured with at least one preformed lateral fold line such that folding the bridging element along the preformed lateral fold line render the base system in a compact storage state.

According to a further teaching of the present invention, each of side end walls further includes at least two horizontally spaced apart downwardly extending engagement slots and the side wall includes at least two upwardly extending engagement slots, each of the engagement slots located in a region adjacent to a lateral extremity of the side wall, and each of the upwardly extending engagement slots of the side wall mates with a corresponding the downwardly extending engagement slot in each of the end walls thereby interconnecting the side wall with the two end walls.

According to a further teaching of the present invention, each the end wall is configured from at least two layers of material such that each of the downwardly extending engagement slots is configured from corresponding slot portions formed in each of the layers of the end walls such that each of the downwardly extending engagement slots includes an inwardly projecting ridge.

According to a further teaching of the present invention, each of the upwardly extending engagement slots is configured from at least two layers of material such that corresponding slot portions formed in each of the layers of the side walls such that each of the upwardly extending engagement slots includes a surface channel for engaging the projecting ridge.

According to a further teaching of the present invention, the base system is integrally formed from a single sheet of folded material such that folds demarcate the bridging element from the two end walls.

There is also provided according to the teachings of the present invention, a method for constructing a crib comprising: (a) providing a base system including two end walls configured from foldable sheet material; (b) folding a first fold in at least one wall assembly configured from foldable sheet material along at least a first preformed fold line so as to form at least one side wall and at least a portion of a support element, the first fold line forming an integral hinge demarcating the one side wall and the at least a portion of a support element; and (c) interconnecting each of two opposite ends of the wall assembly with one of the two end walls such that the two end walls extend below the support element.

According to a further teaching of the present invention, there is also provided, folding the wall assembly along at least the first and a second preformed fold lines which form two integral hinges, so as to form a support element flanked by two side walls.

According to a further teaching of the present invention, there is also provided, folding the wall assembly along at least a third, fourth and fifth preformed fold lines in the support element so as to form a downwardly projecting "V" shaped reinforcement rib in the support element.

According to a further teaching of the present invention, there is also provided, forming each of the end walls from a separate single sheet of material by folding an end-wall blank over on itself along an end-wall fold such that an outline of a first segment of the end wall on one side of the end-wall fold is substantially a mirror image of at least a portion of an outline of a second segment of the end wall on another side of the end-wall fold.

According to a further teaching of the present invention, there is also provided, fixedly attaching abutting surfaces of the first and the second segments, when the end-wall blank is folded.

According to a further teaching of the present invention, the at least one wall assembly is implemented as two wall assemblies.

According to a further teaching of the present invention, there is also provided, forming each the wall assembly from a single sheet by folding a wall-assembly blank over on itself along a side-wall fold such that an outline of a first section of the side wall on one side of the side-wall fold is substantially a mirror image of at least a portion of an outline of a second section of the side wall on another side of the side-wall fold.

According to a further teaching of the present invention, there is also provided, fixedly attaching abutting surfaces of the first and second sections of the side wall, when the wall-assembly blank is folded.

According to a further teaching of the present invention, there is also provided, folding each the wall assembly along a preformed reinforcement rib fold line so as to form a reinforcement rib projecting downwardly along an edge of the portion of the support element.

According to a further teaching of the present invention, there is also provided, attaching at least one bridging element to each of the end walls such that the two end walls are mechanically linked by the bridging element, and the end walls extend below the bridging element.

According to a further teaching of the present invention, there is also provided, forming the base system from a single sheet of folded material folding a base-system blank along fold lines that demarcate the bridging element from the two end walls as integrally formed portions of the base system.

According to a further teaching of the present invention, there is also provided, rotating the end walls about at least one fold line so as to be variable between a compact storage state and an assembly state.

According to a further teaching of the present invention, the interconnecting includes engaging ones of at least two horizontally spaced apart downwardly extending engagement slots in each of the end walls with corresponding ones of at least two upwardly extending engagement slots in each of the side wall, each of the upwardly extending engagement slots located in a region adjacent to a lateral extremity of the side wall.

According to a further teaching of the present invention, each the end wall is implemented as at least two attached layers of material such that each of the downwardly extending engagement slots is configured from corresponding slot portions formed in each of the layers of the end walls such that each of the downwardly extending engagement slots includes an inwardly projecting ridge.

According to a further teaching of the present invention, each of the side walls is implemented as at least two attached layers such that each of the upwardly extending engagement slots is configured such that corresponding slot portions formed in each of the layers of the side walls and each of the upwardly extending engagement slots includes a surface channel for engaging the projecting ridge.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a crib constructed from foldable material that forms multiple elements from a single sheet of material, and supports the user above the ground.

The principles and operation of a crib constructed from foldable material that forms multiple elements from a single sheet of material, and supports the user above the ground according to the present invention may be better understood with reference to the drawings and the accompanying description.

By way of introduction, it should be noted that while the discussion herein is directed to two preferred embodiments of the present invention that are configured as rocking cradles, the principles of the present invention may be applied with equal benefit to embodiments with stable non-rocking configurations as well. Therefore, except where directly referring to features of the present invention relating specifically to rocking, it is understood the term "crib" as used herein refers to an infant bed, both rocking and non-rocking.

As will be discussed below, there are several features of the present invention that can be used in synergy as illustrated by the preferred embodiments, but are of value when implemented separately. These features include folding a single piece of foldable material so as to form at least one side wall and at least a portion of a support element (bed bottom section), interconnecting the two end walls with a bridging element that is supported above the surface of the ground, and interconnecting the wall assembly and the base system using interconnecting slots. It should be noted that the phrase "above the ground" as used here in refers preferably to a range of 20%–70% of the overall height of the crib, although any distance above the ground is within the scope of the present invention.

Figure 20:
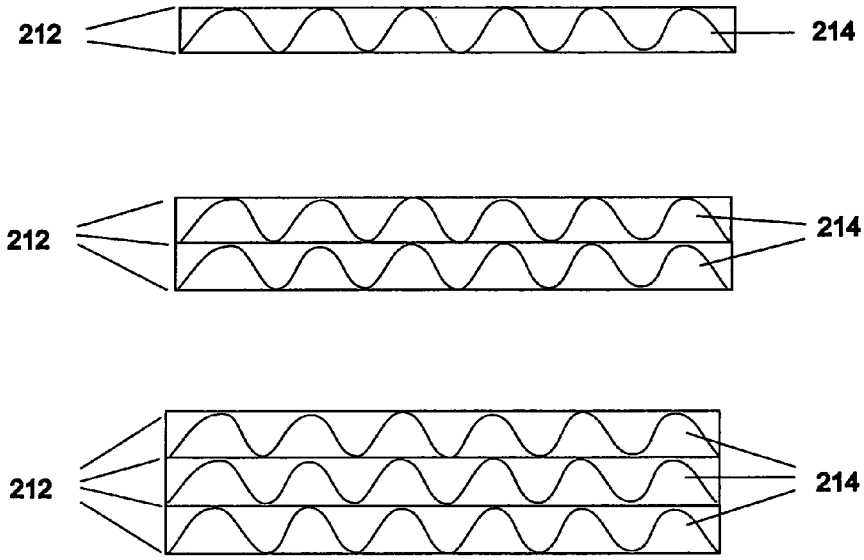
FIG. 20 is a series of schematic illustrations of single, double and triple wall corrugated cardboard.

A principle of the present invention is to construct the crib from foldable material preferably, but not limited to, corrugated cardboard. When corrugated cardboard is used, it may be of single or multiple wall construction. As illustrated in FIG. 20, single wall corrugated cardboard 210 includes one corrugated layer 214 between two flat layers 212. A double wall configuration 220 includes two corrugated layers 214 arranged between three flat layers 212. A triple wall configuration 230 includes three corrugated layers 214 arranged between four flat layers 212.

Figure 5:
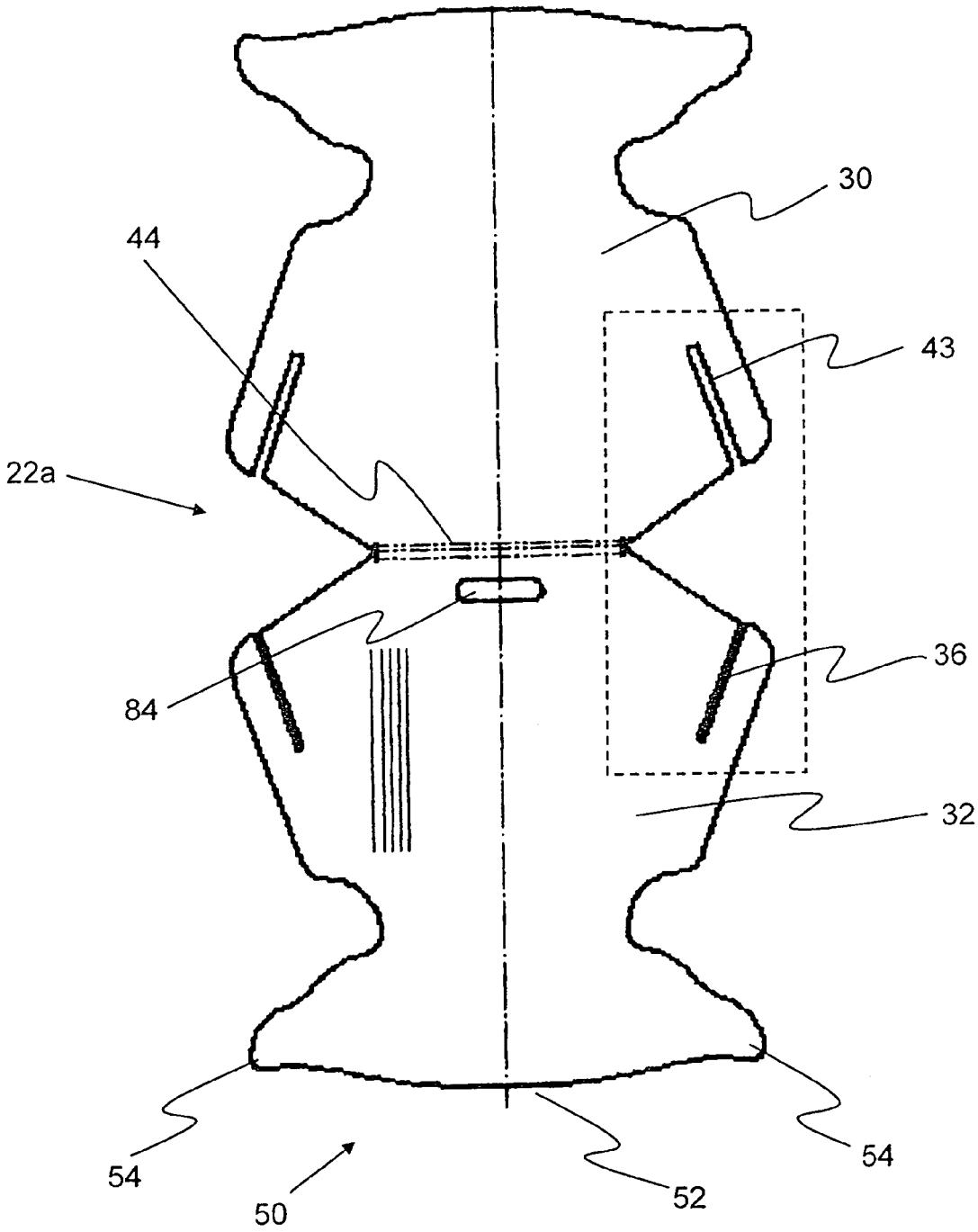
FIG. 5 is a front elevation of an end wall blank of the embodiment of FIG. 4, shown here before being folded.

In some embodiments of the present invention the portions of the crib, such as, but not limited to, end walls and side walls, may be constructed from multiple layers of the foldable material. This may be in the form of bonded together sheets, a single sheets folded over on itself with abutting surfaces bonded together, or a combination of these. In the case of a single folded over sheet, each of the sections may include an outline that is the mirror image of the section that, when the sheet is lying flat, is on the other side of the fold. This is illustrated in FIG. 5 where end wall segments 30 and 32 lie on opposite side of fold line 44 when the sheet is laying flat and the outline of each of the segments is a mirror image of the other. As used herein, the term "outline", when used in conjunction with the phrase "mirror image" refers to the outline of the outer contour of the section or segment, and any slots, or ribs that are part of the section or segment are not included in the "mirror image" unless specifically stated as being so.

Figure 21:
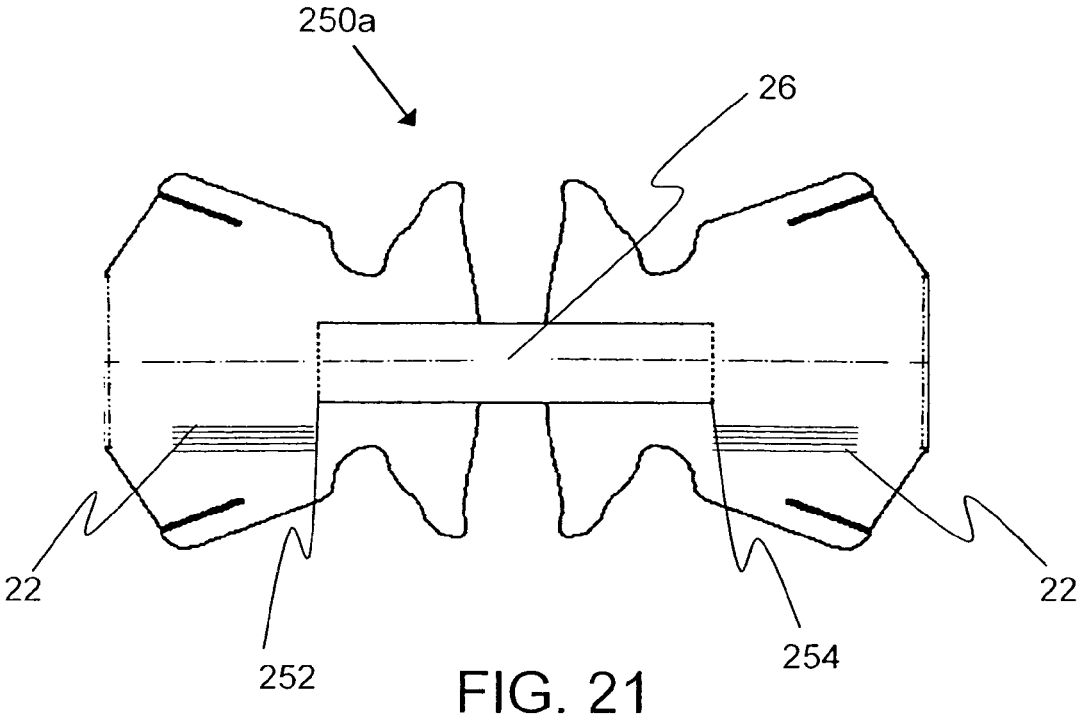
FIG. 21 is a top elevation of a blank for forming a base system, according to the teachings of the present invention, from a single sheet of foldable material.
Figure 22:
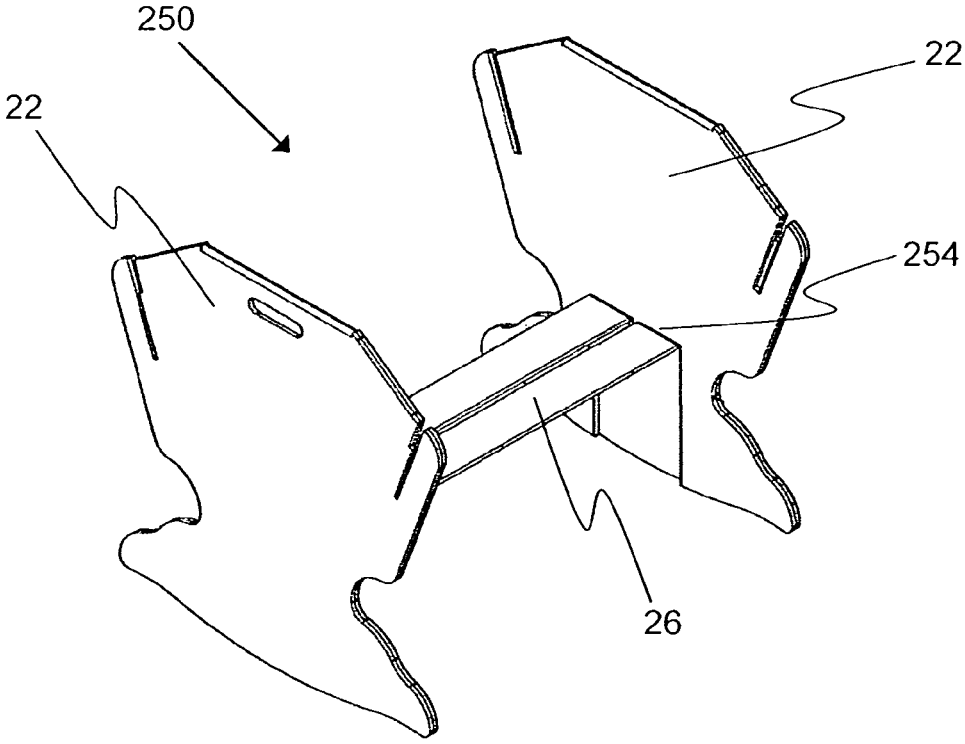
FIG. 22 is a schematic isometric view of the base system of FIG. 21 in an assembled state.

It is a further principle of the present invention to utilize the foldability of the construction material. To that end, in some embodiments, multiple elements may be included in a single blank that is then folded to demarcate the individual elements and deploy them in the appropriate position. Non-limiting examples include the wall assembly 10 of FIG. 3 and the base system blank 250*a* of FIG. 21. The non-limiting example of a base system blank 250*a* is folded along fold lines 252 and 254 in order to form base system 250, as illustrated in FIG. 22, such that the two end walls 22 are linked to each other by an integrally formed bridging element 26, which is formed from the inside section of the end wall that is folded over on itself.

Figure 1:
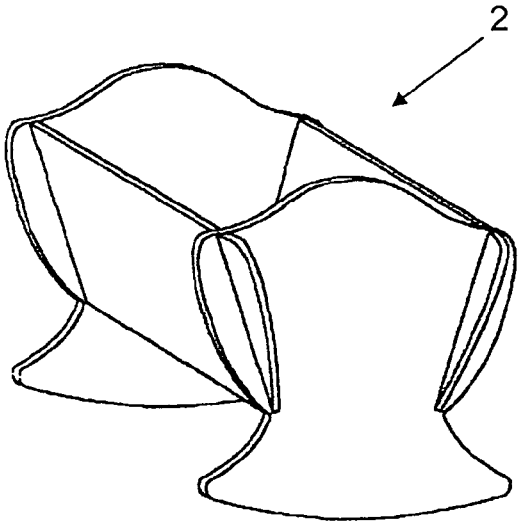
FIG. 1 is a schematic isometric view of a first preferred embodiment of a crib constructed and operable according to the teachings of the present invention.
Figure 2:
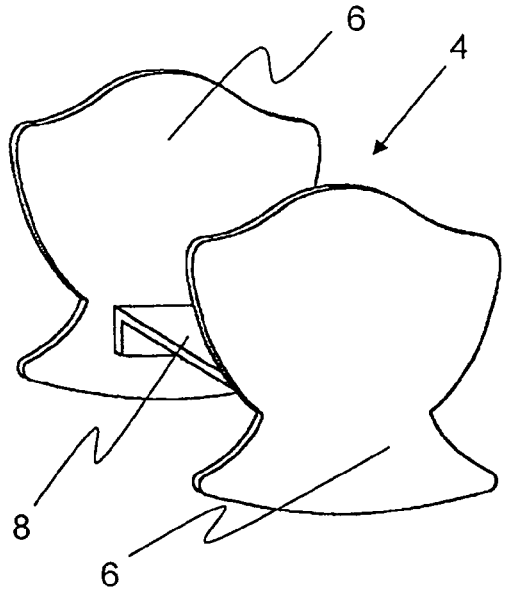
FIG. 2 is a schematic isometric view of the base system of the embodiment of FIG. 1.
Figure 3:
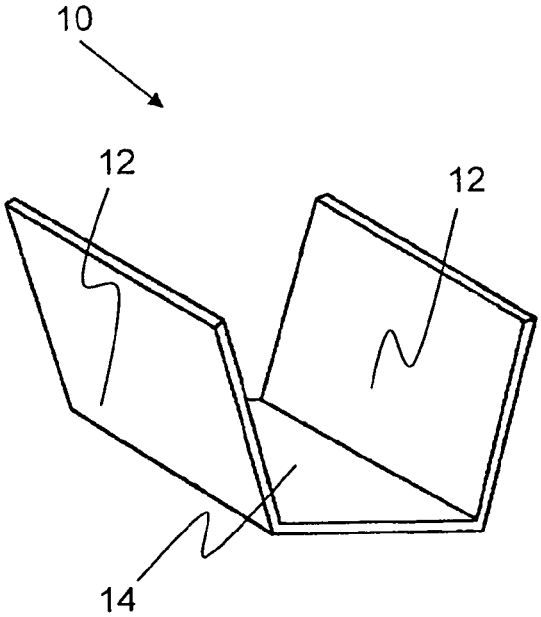
FIG. 3 is a schematic isometric view of the wall assembly of the embodiment of FIG. 1.
Figure 2A:
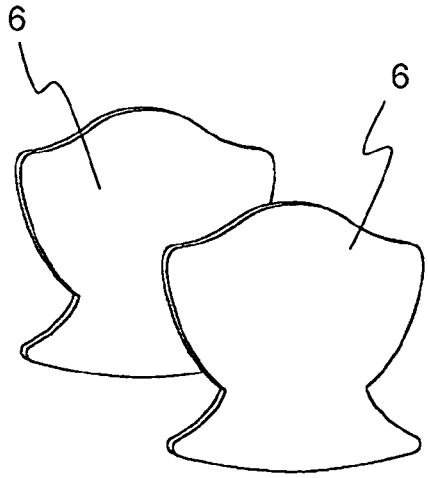
FIG. 2*a* is a schematic isometric view of the base system of the embodiment of FIG. 1 that does include a bridging element.

Referring now to some preferred embodiments, a first preferred embodiment of FIG. 1 illustrates a crib 2 of the present invention is its simplest form. The crib includes a base system 4 (FIG. 2) having two end walls 6 mechanically linked by a bridging element 8. The wall assembly 10 of FIG. 3 is constructed from a single sheet of foldable material that is folded twice to form two side walls 12 flanking a support element 14. The wall assembly is deployed on the bridging element 8 between the two end walls 6 to form the crib 2. Alternatively, the base system may consist of two end walls (FIG. 2*a*) that are mechanically linked only by the wall assembly.

Figure 4:
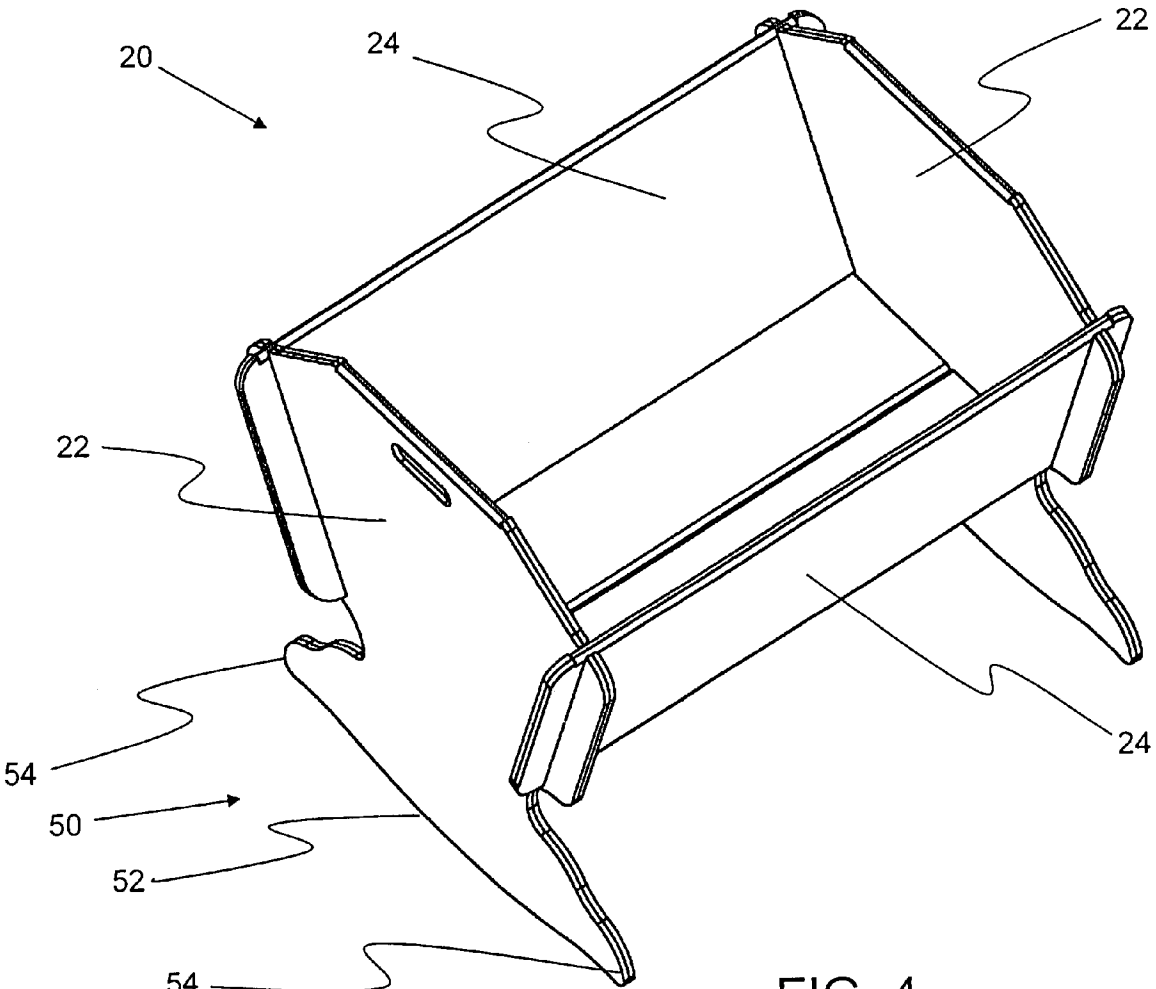
FIG. 4 is a schematic isometric view of a second preferred embodiment of a crib constructed and operable according to the teachings of the present invention.
Figure 14:
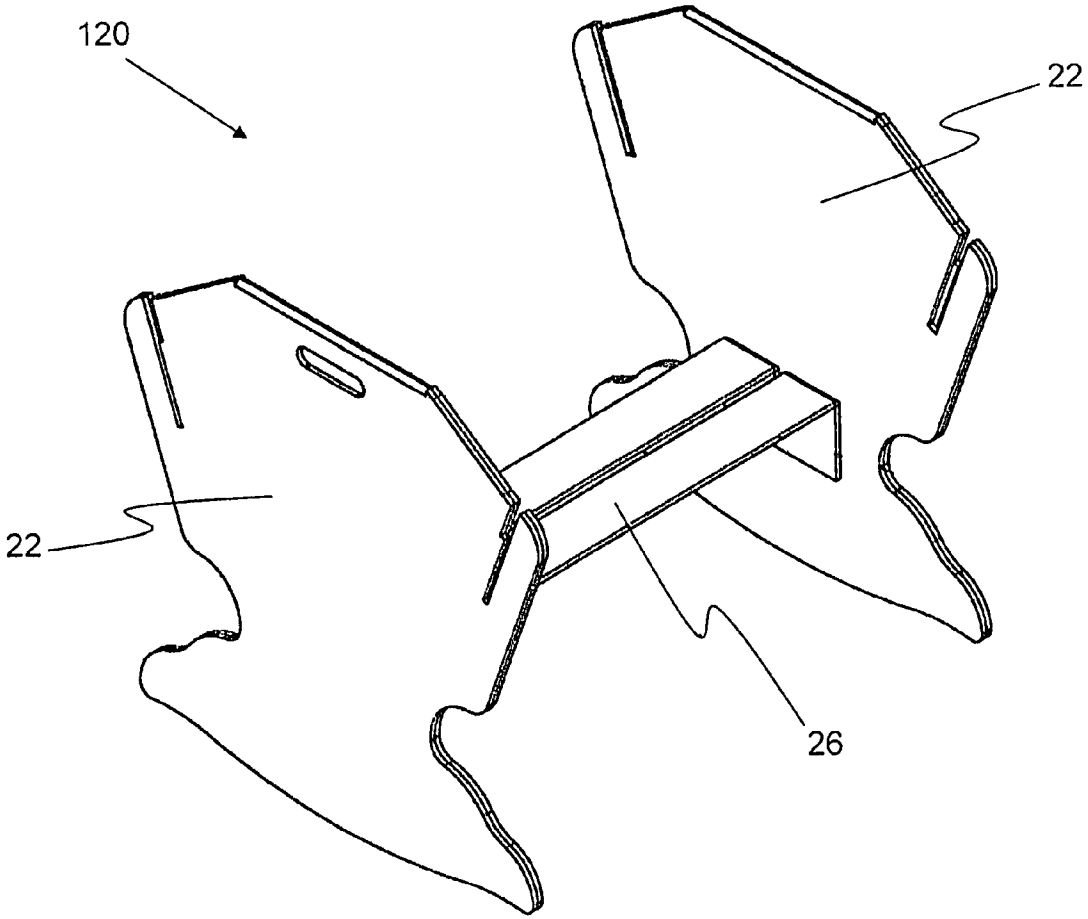
FIG. 14 is a schematic isometric view of a base system of the embodiment of FIG. 4, shown here with the bridging element extended for acceptance of a wall assembly.

The second preferred embodiment of the present invention illustrated in FIG. 4 includes a base system with two end walls 22 linked by a bridging element 26 (see FIG. 14) and two wall assemblies 24. The end walls are constructed from a blank 22*a* of foldable material that is folded over and the abutting surfaces are preferably fixedly attached. Preferably the attachment is by use of a biodegradable adhesive.

Figure 6:
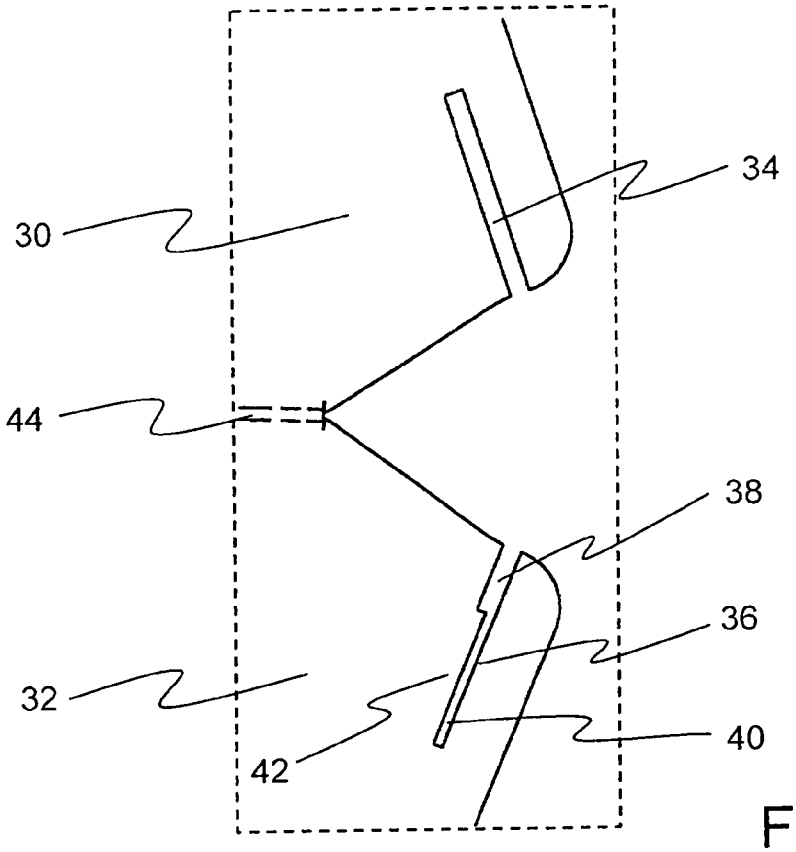
FIG. 6 is a detail of FIG. 5 showing the corresponding portions of the engagement slot before the end wall is folded.
Figure 7:
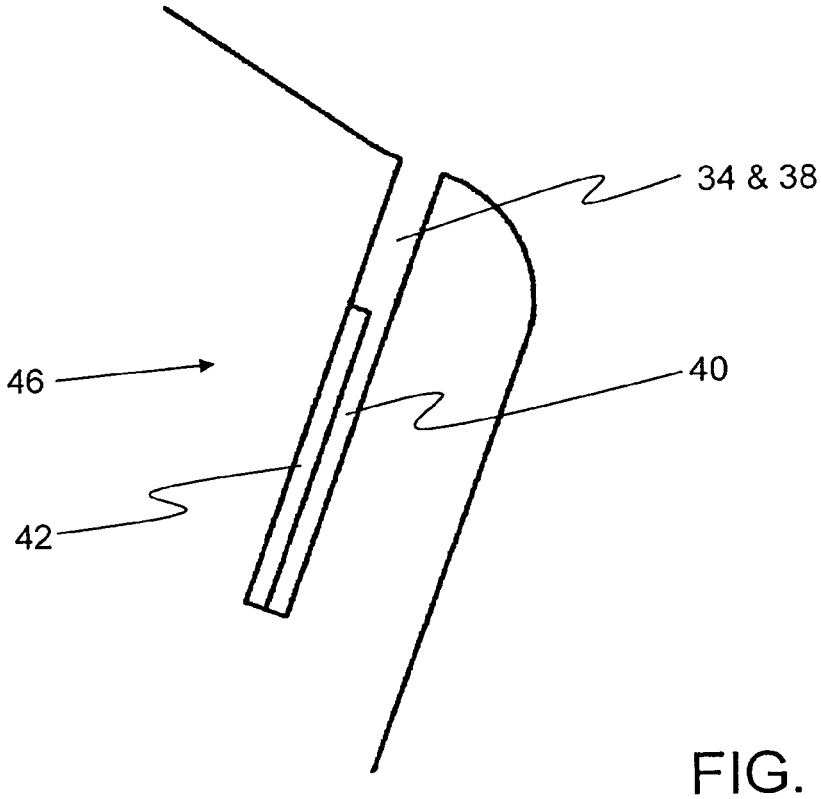
FIG. 7 is a detail of the downwardly extending end wall engagement slot after the end wall is folded.
Figure 8:
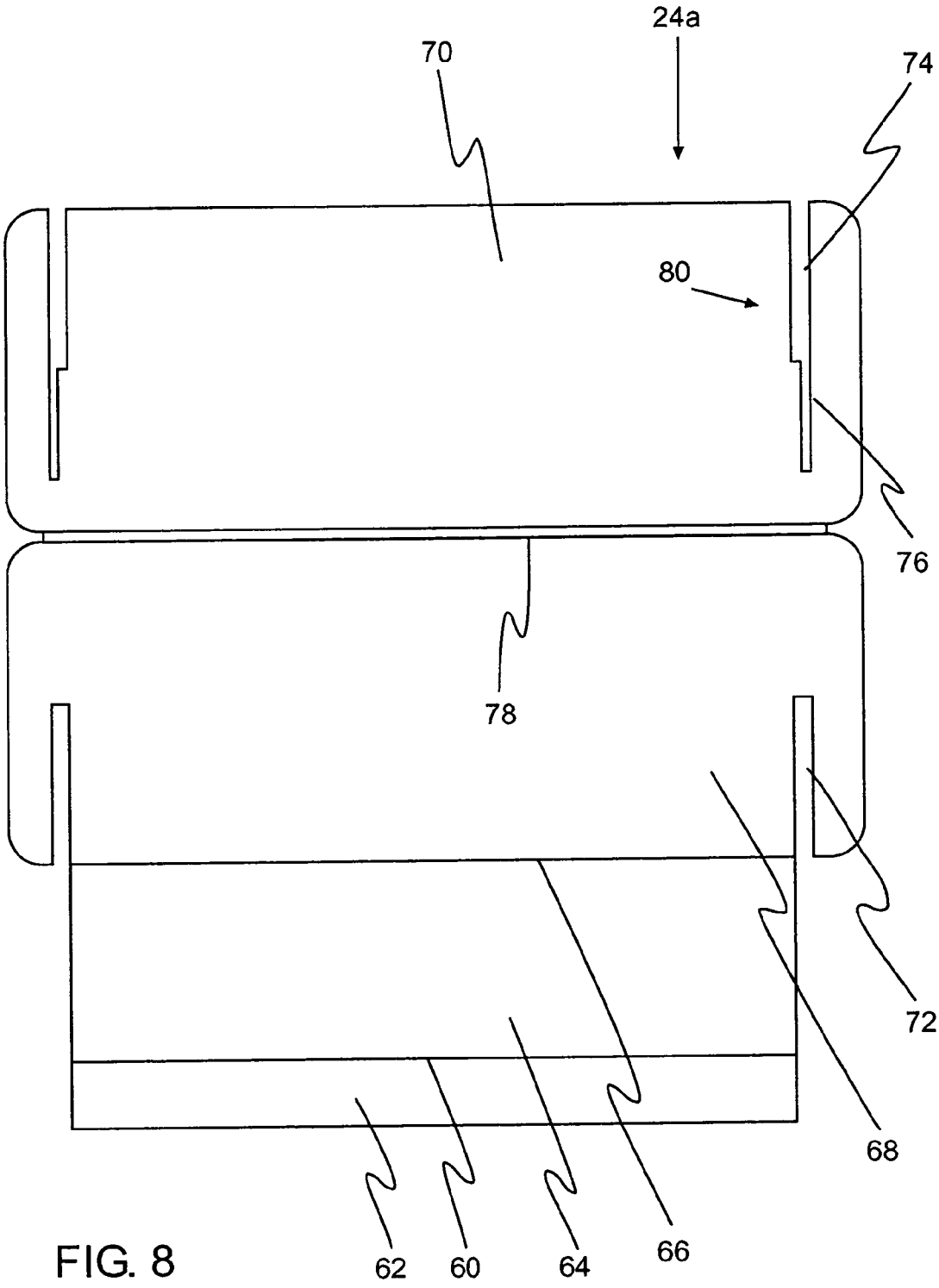
FIG. 8 is a front elevation of a wall assembly of the embodiment of FIG. 4, shown here before the side wall is folded.
Figure 9:
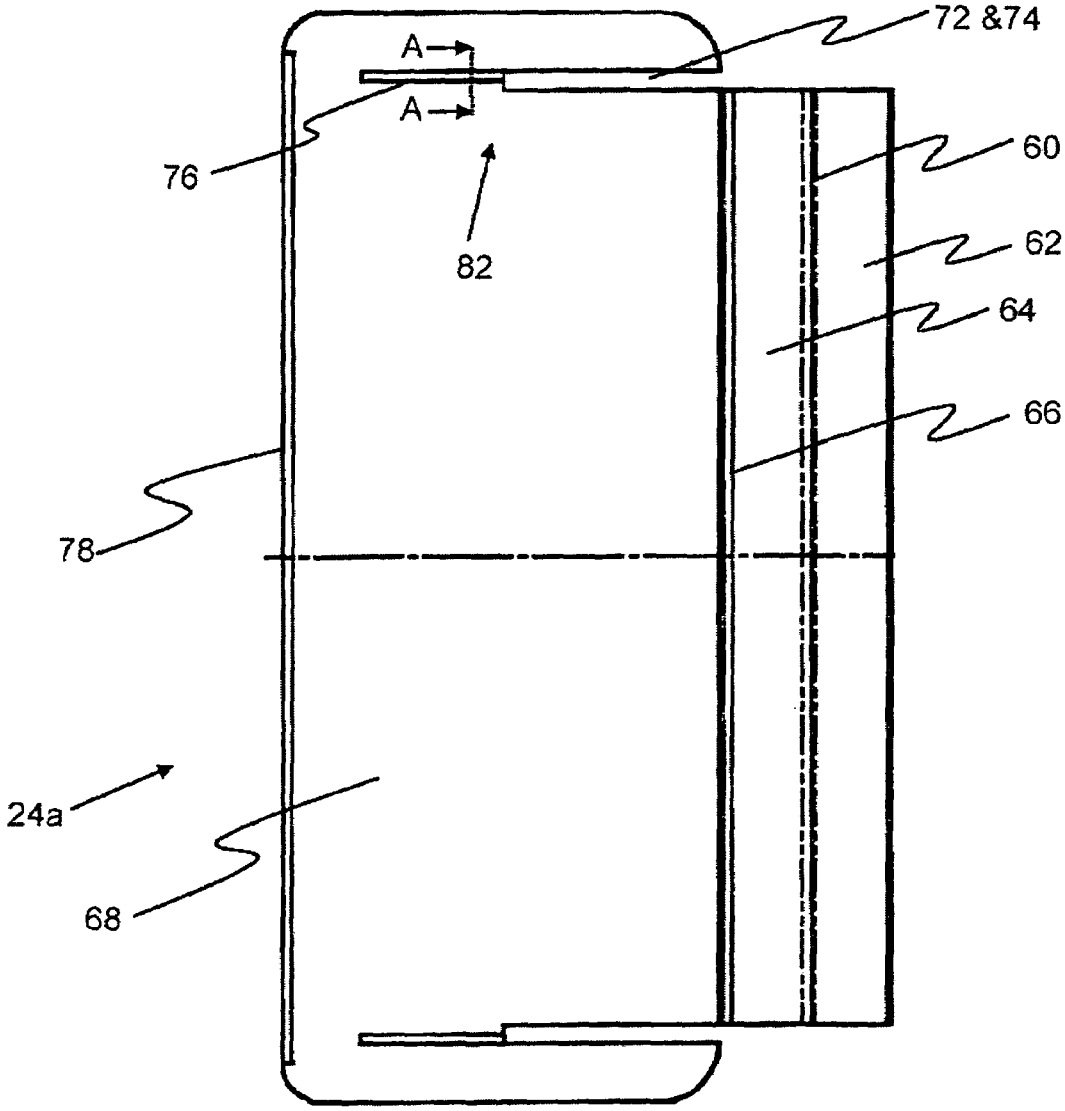
FIG. 9 is a back elevation of the wall assembly of the embodiment of FIG. 4, shown after folding.

Each of segments 30 and 32 of the end wall blank 24*a* includes a portion of the downwardly extending engagement slots that are used to interconnect the wall assemblies and the end walls. It should be noted that the terms "downward" and "upward" as used herein refer to directional orientation of the respective engagement slots at the time of engagement, that is, when the crib is assembled. Each of the slot portions is configured differently, as illustrated in FIG. 6. Slot portion 34 has substantially the same width throughout its entire length. Slot portion 36 has a first portion 38 having a width substantially equal to the width of slot portion 34, and a second portion 40 having a width that is less than the width of the first portion 38. The full engagement slot 46 is formed by folding end wall segment 30 onto segment 32 along fold line such that slot portions 34 and 38 are aligned and a region 42 of segment 32 adjacent to slot portion 40 forms an inwardly projecting ridge extending into slot portion 34. This projection ridge mates with a surface channel configured in the upwardly projecting engagement slot configured in the side wall sections as will be discussed below. The angular orientation of the downwardly extending engagement slot in the end walls determines the angular orientation of the side walls, therefore, the slots preferably slope inwardly as they extend downwardly having a slope ranging from 10°–45° form the vertical, dependent on the particular application, although slopes outside this range are within the scope of the present invention.

It should be noted that the interconnection of the wall assembly and the base system may be achieved in ways other than the use of the preferred arrangement of slots described above. Such interconnection may include, but not be limited to, tabs inserted through slots, adhesive tabs, hook and loop fasteners, pins, nuts and bolts, and screws.

The ground contact surface 50 of the end walls 22 is configured with a curved rocker region 52 that is flanked by rocking range limiters 54 as a safety measure.

Each of the wall assemblies, as illustrated in FIGS. 8–11 is constructed from a blank 24*a* that includes a preformed fold line 60 that is an integral hinge that demarcates the reinforcement rib 62 and the support element 64. Preformed fold line 66 is an integral hinge demarcating the support element 64 and the side wall section 68. Side wall section 68 includes a portion 72 of the upwardly extending side wall engagement slot that has substantially the same width throughout its entire length. The slot portion 80 configured in side wall section 70 includes a first portion 74 having a width substantially equal to the width of slot portion 72, and a second portion 76 having a width that is less than the width of the first portion 72. The outline of side wall section 70 is at least a partial mirror image of side wall section 68, such that when blank 24*a* is folded along fold line 78 the slot portions align so as to form the full engagement slot 82 wherein slot portions 72 and 74 are of substantially equal width and length, and slot portion 76 extends beyond slot portion 74, thereby forming a surface channel for accepting the inwardly projecting ridge of the downwardly extending engagement slot in the end walls.

Figure 10:
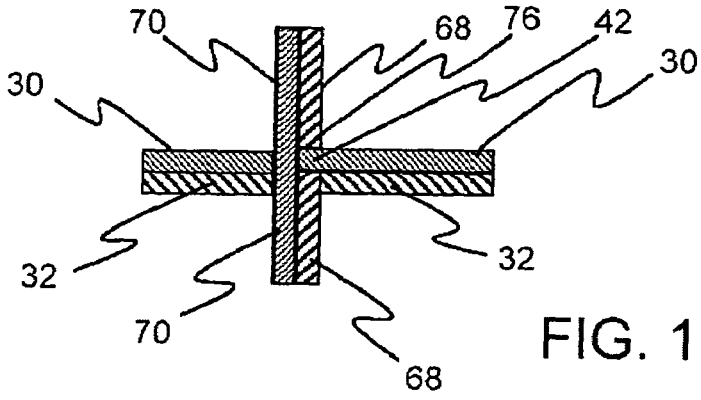
FIG. 10 is a top elevation of a cross sectional view of the interconnecting of the end wall and side wall taken along line A of FIG. 9.
Figure 11:
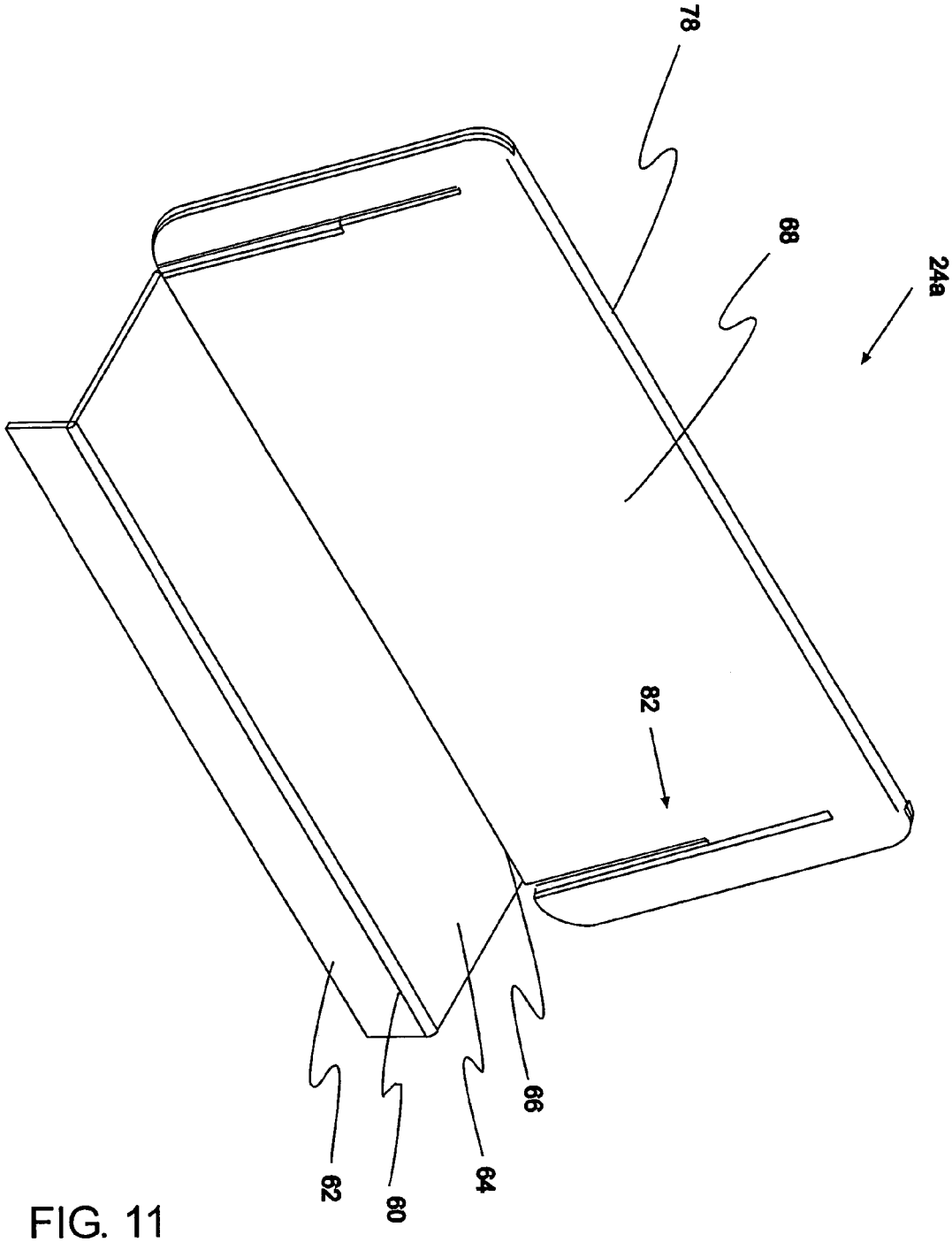
FIG. 11 is a schematic isometric view of the wall assembly of FIG. 8 after folding in preparation of interconnection with the base system of FIG. 14.

The cross-sectional view of FIG. 10 illustrates the interconnection of side wall with the end wall. At this interconnection region, side wall section 70 passes through slot portion 40, and side wall section 68 passes only through slot portion 34 and traps end wall projection ridge 42 in surface channel 76.

Figure 12:
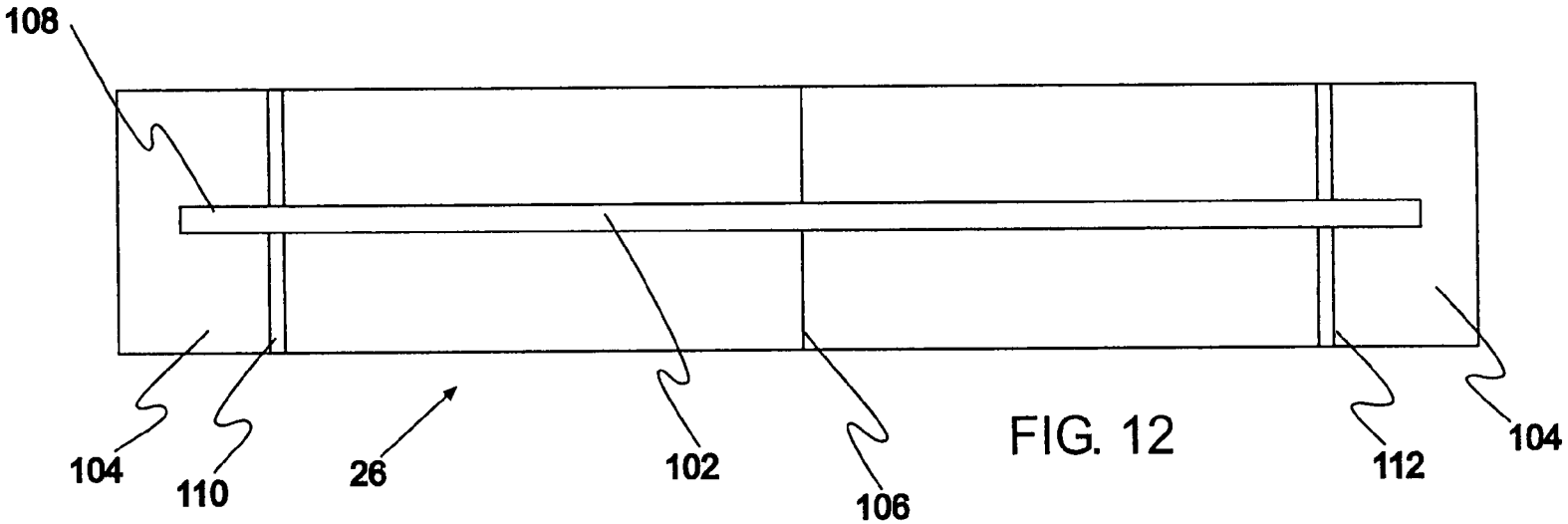
FIG. 12 is a top elevation of a first preferred embodiment of a bridging element constructed and operable according to the teachings of the present invention, shown here before folding.
Figure 13:
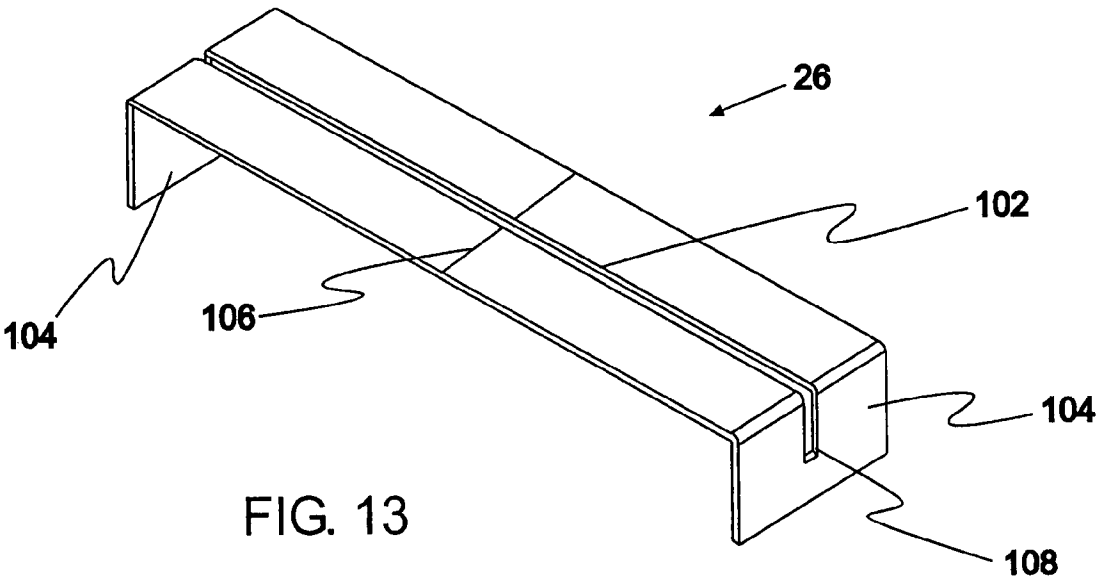
FIG. 13 is a schematic isometric view of the bridging element of FIG. 12, shown after folding.
Figure 15:
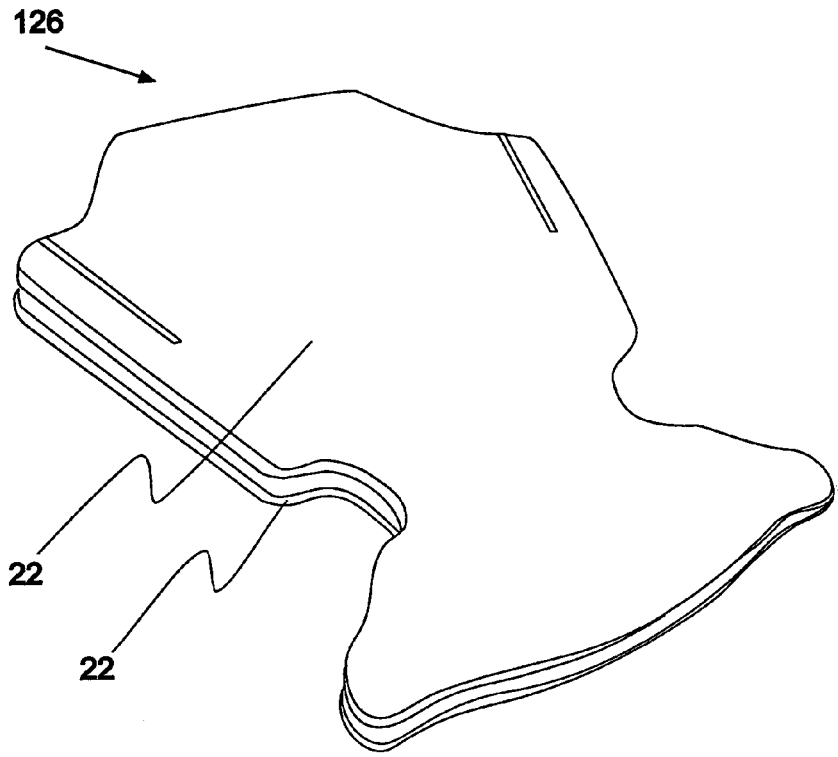
FIG. 15 is a schematic isometric view of a base system of the embodiment of FIG. 4, shown here with the bridging element folded such that the base system is in a storage mode.

The non-limiting preferred embodiment of a bridging element 26 as illustrated in FIGS. 12 and 13 includes a slot 102 for releasably engaging the reinforcement ribs 62 of the walls assemblies 24*a*. The ends of the bridging element 26 are folded along fold lines 110 and 112 to form attachment flaps 104 which are used to attach the bridging element 26 to each of the end walls 22 so as to form the base system 120 (FIG. 14) of the crib 20. The bridging element 26 may be folded along preformed fold line 106 so as to allow the base system to collapse into a folded storage state 126 (FIG. 15). In this embodiment of the bridging element, the slot 102 extends into the attachment flaps so as to form stabilizing slots 108 which engage the end regions of the reinforcement ribs, thereby aiding the reinforcement ribs.

It will be readily appreciated that a kit consisting of not more than three separate above described pieces, one base system and two wall assemblies for example, may be provided to consumers in a relatively compact and light weight (under 4.5 kg for example) package. Further, assembly of a crib from such a kit is simple, requiring no tools or specialized skills.

It should be noted that a decorative hole may be cut through either end wall segment and/or side wall section so as to create a frame around a region of the abutting wall segment or section or to create a handle, such as the non-limiting example of a handled 84 illustrated in FIG. 5. Decorations may be applied to the region thus framed either before or after folding and attaching the abutting surfaces.

Figure 16:
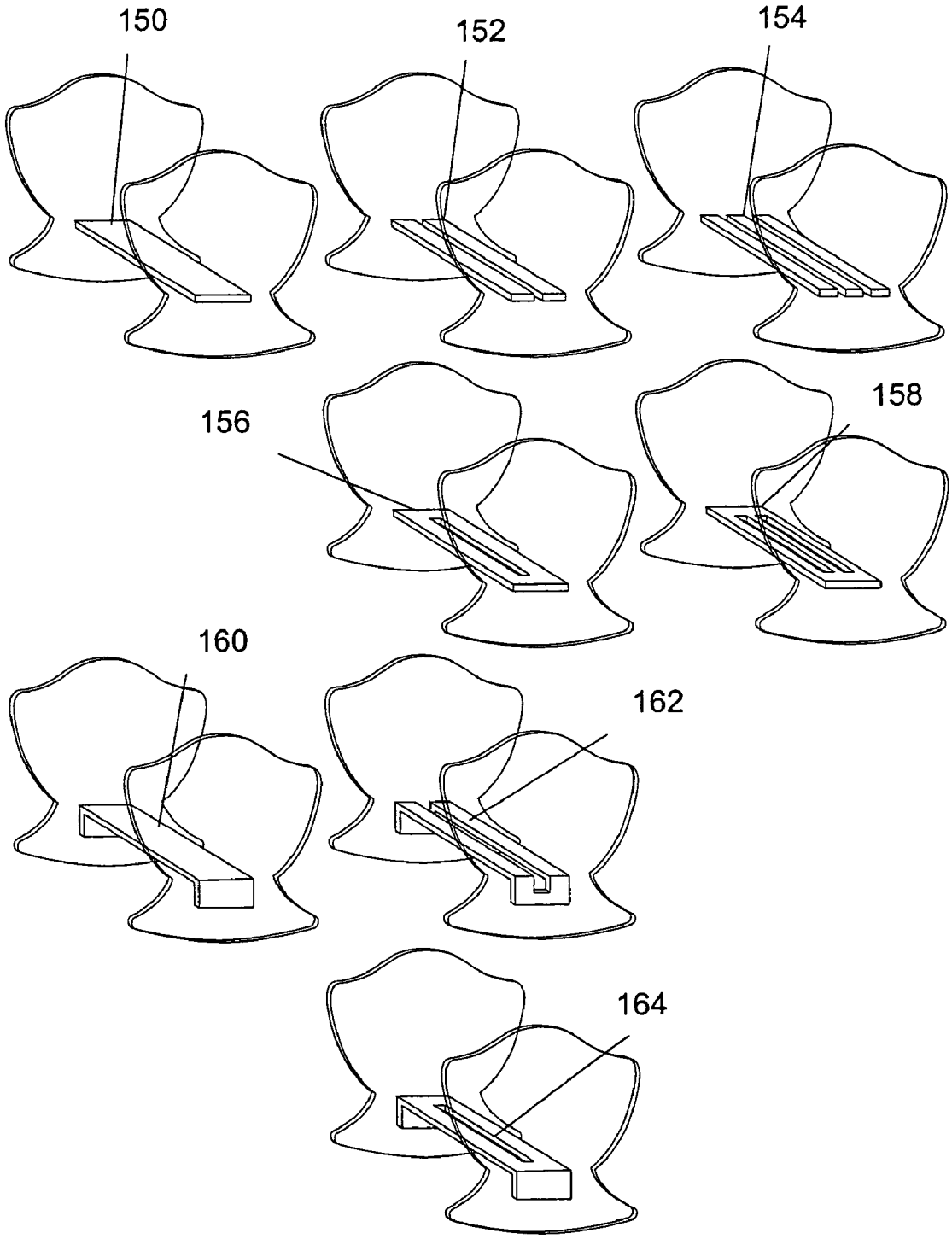
FIG. 16 is a series of schematic isometric views showing possible construction variations of the bridging element according to the teachings of the present invention.

FIG. 16 illustrates some possible variant embodiments of bridging elements such as, but not limited to: a single element 150; two elements forming one slot between them 152; three elements forming two slots between them 154; one element with one slot formed therein 156; one element with two slots formed therein 158; a single element formed with attachment flaps 160; a single element formed with attachment flaps and one slot including stabilization slots 162; and a single element formed with attachment flaps and one slot.

Figure 17:
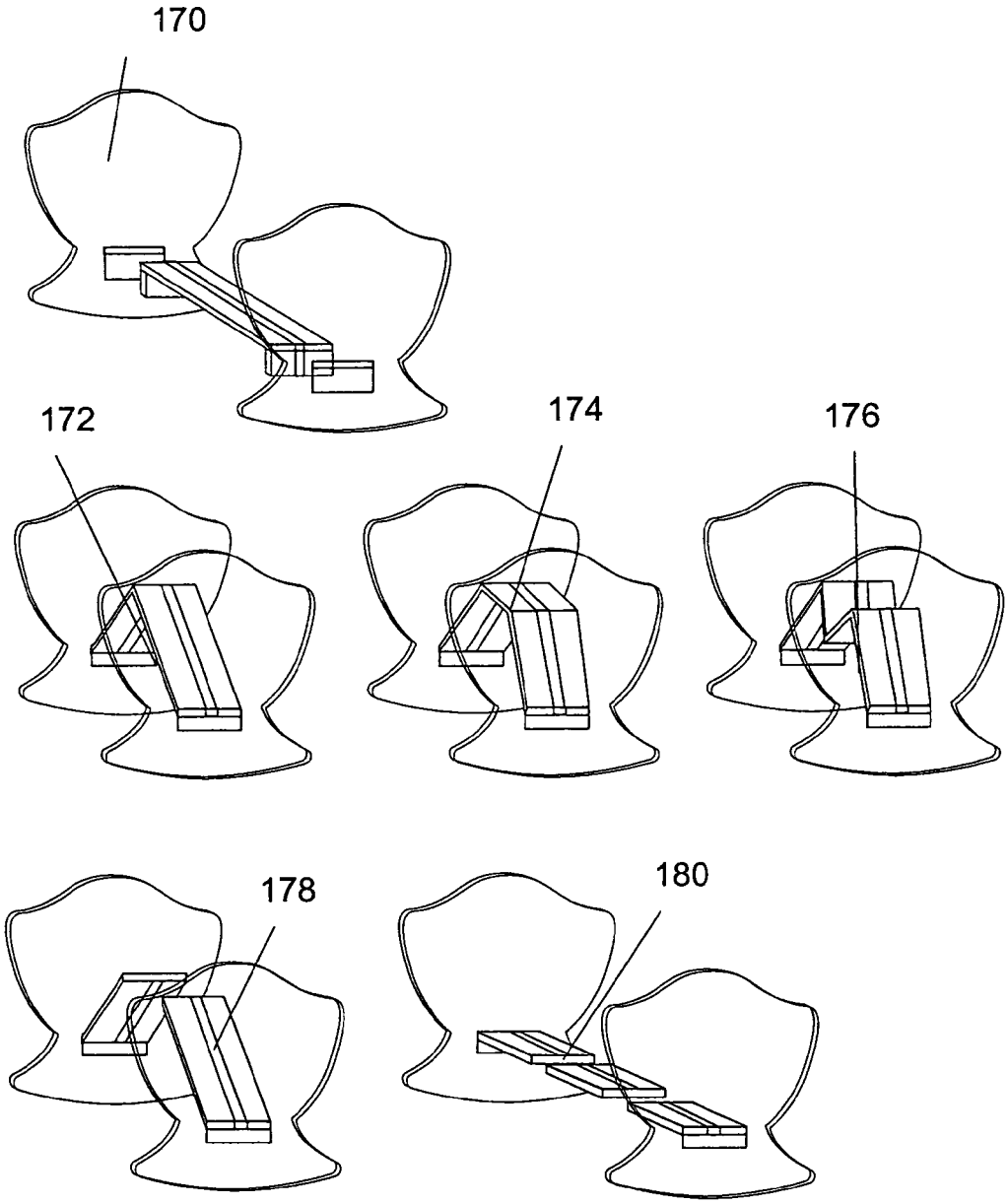
FIG. 17 is a series of schematic isometric views showing folding possible variations of the bridging element according to the teachings of the present invention.

FIG. 17 illustrates some possible variant configurations for folding or otherwise disengaging the bridging element so as to collapse the base system into its folded storage state such as, but not limited to: ridged detachable element 170; element with a single fold 172; element with two folds 174; element with three folds 176; two piece element 178; and a three piece element 180.

Figure 18:
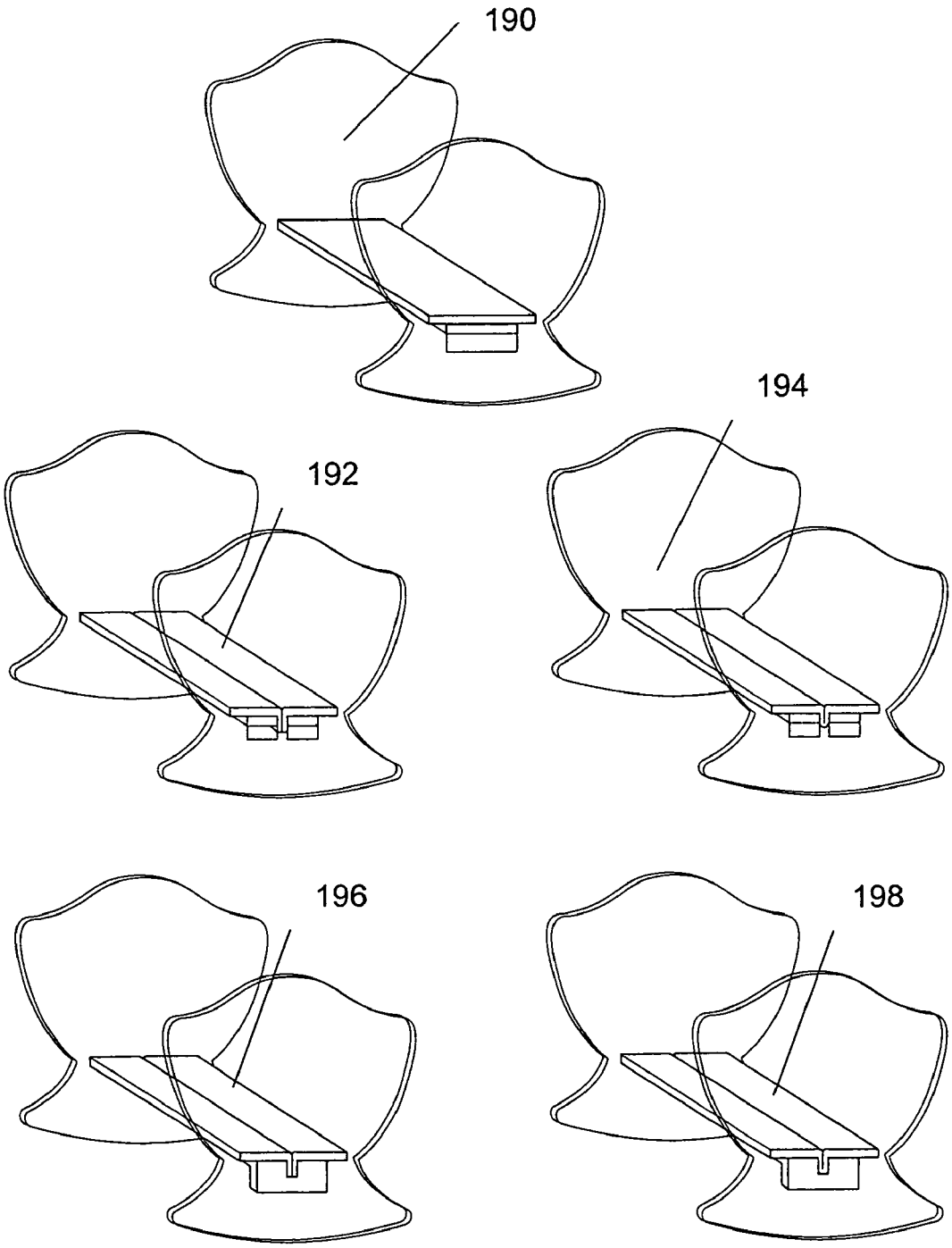
FIG. 18 is a series of schematic isometric views showing possible connection variations of the support element with the bridging element according to the teachings of the present invention.

FIG. 18 illustrates some possible variations of connecting the support element to the bridging element such as, but not limited to: a single support element resting on the bridging element 190; two support elements with reinforcement ribs inserted into a slot in the bridging element 192; a single support element configured with a fold that is inserted into a slot in the bridging element 194; two support elements with reinforcement ribs inserted into a slot in the bridging element and stabilizing slots at each end 196; and a single support element configured with a fold that is inserted into a slot in the bridging element and stabilizing slots on each end 198.

Figure 19:
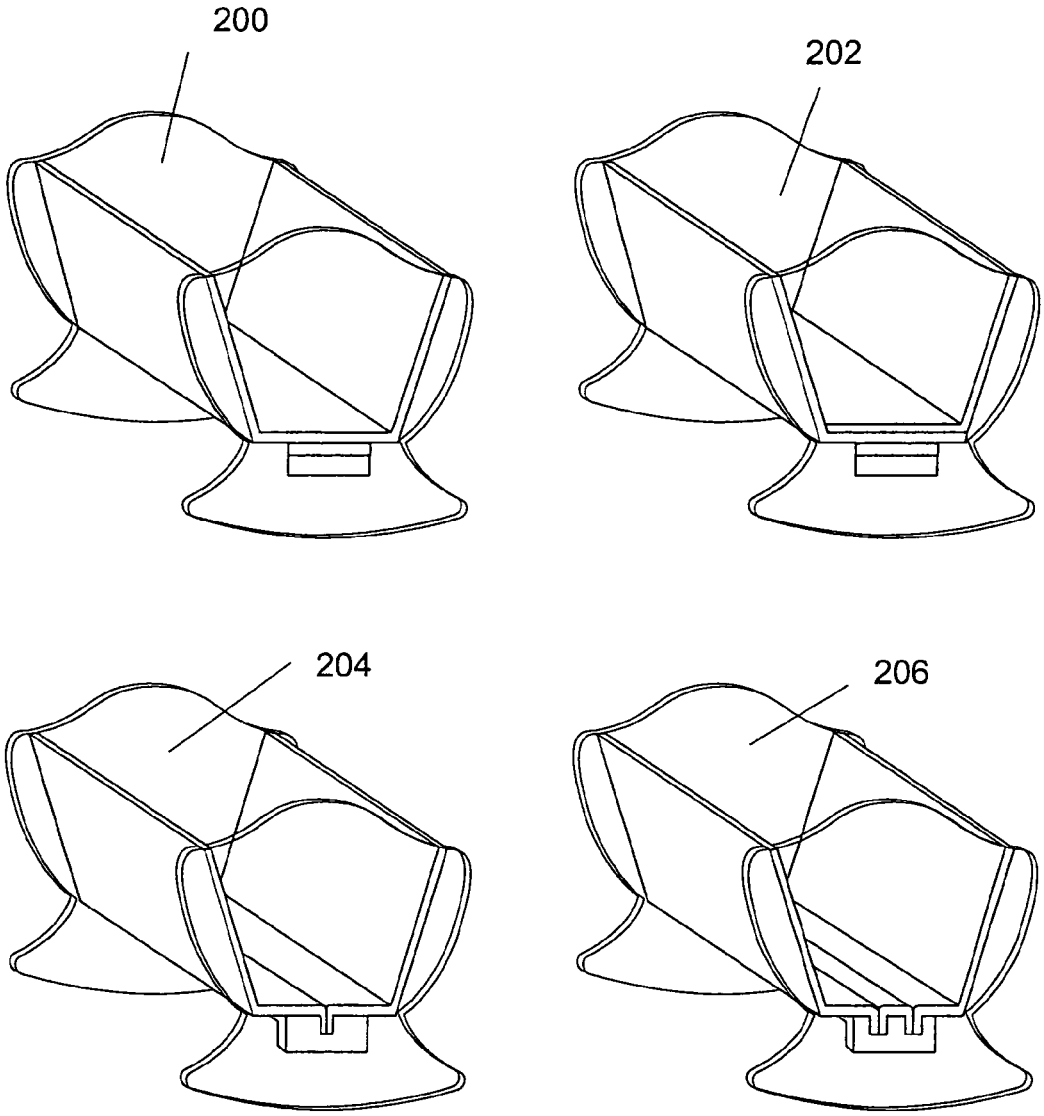
FIG. 19 is a series of schematic isometric views showing possible variations of the wall assembly according to the teachings of the present invention.

Finally, FIG. 19 illustrates some possible variant wall assemblies such as, but not limited to: one piece wall assembly having a support element flanked by side walls 200; two wall assemblies with overlapping support elements 202; two wall assemblies with abutting reinforcement ribs inserted into a slot in the bridging element 204; and two wall assemblies with reinforcement ribs inserted into different ones of two slots in the bridging element with a separate support element filling the gap between the wall assemblies 206.

Construction of a crib according to the teachings of the present invention may include, but not be limited to, the following steps: (It should be noted that some of these steps may be performed as part of a manufacturing process and others may be performed by an end user during final assembly.)

1—Assembly of a base system. This step may include:

Forming two end walls, each of which is formed from a separate single sheet of foldable material that is folded over on itself along an end-wall fold such that an outline of a first segment of the end wall on one side of the end-wall fold is substantially a mirror image of at least a portion of an outline of a second segment of the end wall on another side of the end-wall fold;

Linking the two end walls using a bridging element that is suspended above the ground, and which may include at least one longitudinal slot;

Forming the base system from a single sheet of folded material by folding a base-system blank along fold lines that demarcate the bridging element from the two end walls as integrally formed portions of the base system; and Forming engagement slots in each of the end walls.

2—Forming the wall assembly, which includes at least one side wall and at least a portion of the support element (bed bottom section). This step may include:

Forming two wall assemblies, each of which includes one side wall and a portion of the support element;

Folding a single sheet of foldable material along at least two preformed fold lines so as to form two integral hinges thereby demarcating a support element flanked by two side walls;

Forming a reinforcement rib in the support element; and

Forming engagement slots in regions adjacent to a lateral extremity of the side walls.

3—Interconnecting the base system with the wall assembly such that the end walls extend below the support element and the support element is suspended above the ground. This step may include:

Engagement of the slots in the end walls with the slots in the side walls;

Attachment of the side walls to the end walls using fasteners as mention above; and Insertion of at least one reinforcement rib into a lateral slot in the bridging element.

It should be noted that in any embodiment of the present invention the foldable material may include added materials that may enhance bonding, augment rigidity and/or strength (such as polymers), protect against water damage, and retard fire. Such additives may be impregnated into the material or applied as a coating.

It will be appreciated that the above descriptions are intended only to serve as examples, and that many other embodiments are possible within the spirit and scope of the present invention.

What is claimed is:

1. A crib comprising:

(a) a base system including two end walls configured from foldable sheet material, each of said end walls configured from a single sheet of material folded over on itself on an end-wall fold such that an outline of a first segment of said end wall on one side of said end-wall fold is substantially a mirror image of at least a portion of an outline of a second segment of said end wall on another side of said end-wall fold, and in a folded position, abutting surfaces of said first and said second segments are fixedly attached; and (b) at least one wall assembly configured from foldable sheet material and having at least a first preformed fold line so as to form an integral hinge demarcating at least one side wall and at least a portion of a support element, such that a first fold is formed by folding said wall assembly along said first fold line;

wherein each of two opposite ends of said wall assembly interconnects with one of said two end walls such that said two end walls extend below said support element.

2. The crib of claim 1, wherein said at least one wall assembly is implemented as two wall assemblies, and each of said wall assemblies is configured with a preformed reinforcement rib fold line such that folding said wall assembly along said preformed reinforcement rib fold line forms a reinforcement rib projecting downwardly along an edge of said portion of said support element.

3. The crib of claim 1, wherein said base system further includes at least one bridging element attached to each of said end walls such that said two end walls are mechanically linked by said bridging element, and said end walls extend below said bridging element, and said bridging element is configured with at least one longitudinal slot configured to accept insertion of at least one reinforcement rib.

4. The crib of claim 1, wherein each of said end walls further includes at least two horizontally spaced apart downwardly extending engagement slots and said side wall includes at least two upwardly extending engagement slots, each of said engagement slots located in a region adjacent to a lateral extremity of said side wall, and each of said upwardly extending engagement slots of said side wall mates with a corresponding said downwardly extending engagement slot in each of said end walls thereby interconnecting said side wall with said two end walls, and each said end wall is configured from at least two layers of material such that each of said downwardly extending engagement slots is configured from corresponding slot portions formed in each of said layers of said end walls such that each of said downwardly extending engagement slots includes an inwardly projecting ridge.

5. A crib comprising:

(a) a base system including two end walls configured from foldable sheet material, each of said two end walls having at least two horizontally spaced apart downwardly extending engagement slots;

(b) at least one side wall configured from foldable sheet material and having at least two upwardly extending engagement slots, each of said upwardly extending engagement slots located in a region adjacent to a lateral extremity of said side wall; and (c) at least one support element interconnected with at least one of said base system and said wall assembly, said support element configured to support a load above a surface upon which the crib stands;

wherein each of said upwardly extending engagement slots of said side wall mates with a corresponding said downwardly extending engagement slot in each of said end walls thereby interconnecting said side wall with said two end walls, and each said end wall is configured from at least two layers of material such that each of said downwardly extending engagement slots is configured from corresponding slot portions formed in each of said layers of said end walls such that each of said downwardly extending engagement slots includes an inwardly projecting ridge.

6. The crib of claim 5, wherein each of said end walls is configured from a separate single sheet of material folded over on itself on an end-wall fold such that an outline of a first segment of said end wall on one side of said end-wall fold is a mirror image of at least a portion of an outline of a second segment of said end wall on another side of said end-wall fold, and each of said wall assemblies is further configured with a preformed reinforcement rib fold line such that folding said wall assembly along said preformed reinforcement rib fold line forms a reinforcement rib projecting downwardly along an edge of said support element.

7. The crib of claim 5, wherein said base system further includes at least one bridging element attached to each of said end walls such that said two end walls are mechanically linked by said bridging element, and said end walls extend below said bridging element.

8. The crib of claim 5, wherein each of said upwardly extending engagement slots is configured from at least two layers of material such that corresponding slot portions formed in each of said layers of said side walls such that each of said upwardly extending engagement slots includes a surface channel for engaging said projecting ridge.

9. A crib comprising:

(a) a base system configured from foldable sheet material, said base system including:

(b) two end walls; and (c) at least one bridging element attached to each of said end walls such that said two end walls are mechanically linked by said bridging element, such that said end walls extend above and below said bridging element, and said bridging element is configured with at least one longitudinal slot configured to accept insertion of at least one reinforcement rib;

(c) at least one side wall configured from foldable sheet material, wherein each of two opposite ends of said side wall interconnects with one of said two end walls such that said two end walls extend below said support element; and (d) at least one support element configured to interconnect with at least one of said base system and said side wall, said support element configured to rest on said bridging element;

wherein each of two opposite ends of said wall assembly interconnects with one of said two end walls such that said two end walls extend below said support element.

10. The crib of claim 9, wherein each of said end walls further includes at least two horizontally spaced apart downwardly extending engagement slots and said side wall includes at least two upwardly extending engagement slots, each of said engagement slots located in a region adjacent to a lateral extremity of said side wall, and each of said upwardly extending engagement slots of said side wall mates with a corresponding said downwardly extending engagement slot in each of said end walls thereby interconnecting said side wall with said two end walls.

11. The crib of claim 9, wherein said at least one wall assembly is implemented as two wall assemblies, and each of said wall assemblies is further configured with a preformed reinforcement rib fold line such that folding said wall assembly along said preformed reinforcement rib fold line forms a reinforcement rib projecting downwardly along an edge said support element.

12. The crib of claim 9, wherein said bridging element is configured such that each end is folded so as to form attachment flaps to facilitate attachment to said end walls.

13. The crib of claim 12, wherein said longitudinal slot extends into said attachment flaps so as to form stabilizing slots adjacent to surfaces of each of said end wall, said stabilizing slots accepting terminal edges of said reinforcement rib.

14. The crib of claim 9, wherein said bridging element is configured with at least one preformed lateral fold line such that folding said bridging element along said preformed lateral fold line render said base system in a compact storage state.

15. The crib of claim 9, wherein each of side end walls further includes at least two horizontally spaced apart downwardly extending engagement slots and said side wall includes at least two upwardly extending engagement slots, each of said engagement slots located in a region adjacent to a lateral extremity of said side wall, and each of said upwardly extending engagement slots of said side wall mates with a corresponding said downwardly extending engagement slot in each of said end walls thereby interconnecting said side wall with said two end walls, each said end wall is configured from at least two layers of material such that each of said downwardly extending engagement slots is configured from corresponding slot portions formed in each of said layers of said end walls such that each of said downwardly extending engagement slots includes an inwardly projecting ridge, and each of said upwardly extending engagement slots is configured from at least two layers of material such that corresponding slot portions formed in each of said layers of said side walls such that each of said upwardly extending engagement slots includes a surface channel for engaging said projecting ridge.

16. The crib of claim 9, wherein said base system is integrally formed from a single sheet of folded material such that folds demarcate said bridging element from said two end walls.

17. A method for constructing a crib comprising:

(a) providing a base system including two end walls configured from foldable sheet material and a bridging element configured with at least one longitudinal slot, such that said two end walls are mechanically linked by said bridging element, and said end walls extend below said bridging element;

(b) folding a first fold in at least one wall assembly configured from foldable sheet material along at least a first preformed fold line so as to form at least one side wall and at least a portion of a support element, said first fold line forming an integral hinge demarcating said one side wall and said at least a portion of a support element; and (c) interconnecting each of two opposite ends of said wall assembly with one of said two end walls such that said two end walls extend below said support element.

18. The method of claim 17, further comprising forming each of said end walls from a separate single sheet of material by folding an end-wall blank over on itself along an end-wall fold such that an outline of a first segment of said end wall on one side of said end-wall fold is substantially a mirror image of at least a portion of an outline of a second segment of said end wall on another side of said end-wall fold, and fixedly attaching abutting surfaces of said first and said second segments, when said end-wall blank is folded.

19. The method of claim 17, wherein said at least one wall assembly is implemented as two wall assemblies.

20. The method of claim 19, further comprising forming each said wall assembly from a single sheet by folding a wall-assembly blank over on itself along a side-wall fold such that an outline of a first section of said side wall on one side of said side-wall fold is substantially a mirror image of at least a portion of an outline of a second section of said side wall on another side of said side-wall fold, and fixedly attaching abutting surfaces of said first and second sections of said side wall, when said wall-assembly blank is folded.

21. The method of claim 19, further comprising folding each said wall assembly along a preformed reinforcement rib fold line so as to form a reinforcement rib projecting downwardly along an edge of said portion of said support element.

22. The method of claim 21, further comprising inserting at least one said reinforcement rib into said least one longitudinal slot.

23. The method of claim 21, further comprising rotating said end walls about at least one fold line so as to be variable between a compact storage state and an assembly state.

24. The method of claim 21, wherein said interconnecting includes engaging ones of at least two horizontally spaced apart downwardly extending engagement slots in each of said end walls with corresponding ones of at least two upwardly extending engagement slots in each of said side wall, each of said upwardly extending engagement slots located in a region adjacent to a lateral extremity of said side wall, each said end wall is implemented as at least two attached layers of material such that each of said downwardly extending engagement slots is configured from corresponding slot portions formed in each of said layers of said end walls such that each of said downwardly extending engagement slots includes an inwardly projecting ridge, and each of said side walls is implemented as at least two attached layers such that each of said upwardly extending engagement slots is configured such that corresponding slot portions formed in each of said layers of said side walls and each of said upwardly extending engagement slots includes a surface channel for engaging said projecting ridge.

* * * * *